US006119776A

United States Patent [19]

Graham et al.

[11] Patent Number: 6,119,776

[45] **Date of Patent: *Sep. 19, 2000**

[54] METHODS OF STIMULATING AND PRODUCING MULTIPLE STRATIFIED RESERVOIRS

[75] Inventors: Stephen A. Graham, Caracas, Venezuela; Raymond L. Brown, Houston; David S. Stegemeier, Sugar Land, both of Tex.

[73] Assignee: Halliburton Energy Services, Inc., Duncan, Okla.

[ * ] Notice: This patent is subject to a terminal disclaimer.

[21] Appl. No.: 09/076,428

[22] Filed: May 12, 1998

Related U.S. Application Data

[63] Continuation-in-part of application No. 09/022,922, Feb. 12, 1998.

[51] Int. Cl.[7] ..... E21B 43/243

[52] U.S. Cl. ..... 166/245; 166/271; 166/272.2

[58] Field of Search ..... 166/245, 272.7, 166/272.2, 271, 402, 308

[56] References Cited

U.S. PATENT DOCUMENTS

| | | | |
|---|---|---|---|
| 4,390,067 | 6/1983 | Willman | 166/245 |
| 4,598,770 | 7/1986 | Shu et al. | 166/245 |
| 4,633,948 | 1/1987 | Closmann | 166/271 |
| 4,832,122 | 5/1989 | Corey et al. | 166/266 |
| 5,074,360 | 12/1991 | Guinn | 166/281 |
| 5,211,230 | 5/1993 | Ostapovich et al. | 166/245 |
| 5,215,146 | 6/1993 | Sanchez | 166/263 |

*Primary Examiner*—William Neuder

*Attorney, Agent, or Firm*—Robert A. Kent; C. Clark Dougherty, Jr.

[57] ABSTRACT

Methods of stimulating and producing multiple stratified hydrocarbon reservoirs having numerous separate reservoir compartments are provided. The methods basically comprise the steps of drilling a first well bore into a lower part of the reservoir having a horizontal portion which intersects a previously drilled second well bore therein. At least one fracture is formed extending into two or more reservoir compartments from the horizontal portion of the third well bore for conducted hydrocarbons in the reservoir into the horizontal portion of the first well bore from where the hydrocarbons flow into the second well bore and are withdrawn.

20 Claims, 6 Drawing Sheets

METHODS OF STIMULATING AND PRODUCING MULTIPLE STRATIFIED RESERVOIRS

RELATED APPLICATION DATA

This is a continuation-in-part of application Ser. No. 09/022,922 filed on Feb. 12, 1998.

BACKGROUND OF THE INVENTION

1. Field of the Invention

The present invention relates to methods of stimulating and producing multiple stratified low permeability hydrocarbon reservoirs having numerous separate reservoir compartments.

2. Description of the Prior Art

Field areas containing multiple stratified or laminated hydrocarbon bearing formations exist in some parts of the world. Such field areas are comprised of a large number of sandstone or other permeable rock layers containing hydrocarbons that are encased or separated by shale or other relatively impermeable rock layers of varying thickness. In addition, the sandstone layers often do not extend in a homogeneous fashion over an extensive area due to lateral stratigraphic variations and structural trapping features such as sealing faults. This lateral stratigraphic variation and structural trapping coupled with the presence of impermeable rock layers create numerous separate reservoir compartments of varying size over a relatively large vertical laminated sequence and field area. In many field areas, these reservoir compartments contain large quantities of hydrocarbons.

The production of hydrocarbons from multiple stratified hydrocarbon reservoirs has heretofore been a low economic return venture for oil and gas exploitation companies even when significant oil and gas has been confirmed to be in place. The problem is that the hydrocarbons are contained in numerous relatively small reservoir compartments, many of which cannot be practically or economically penetrated by well bores. The problem is further complicated by the fact that the reservoir formations containing the hydrocarbons have relatively low permeabilities.

Heretofore, attempts have been made to produce the low permeability reservoir compartments of multiple stratified reservoirs by way of hydraulic fracture stimulated wells. These well stimulation treatments involve the injection of viscous fracturing fluids into subterranean formations at rates and pressures sufficient to fracture the formations. Proppant material, such as sized sand, is mixed with the fracturing fluid to keep the created fractures open after the fracturing process is concluded. In most cases, the fractures formed in the stratified hydrocarbon bearing formations are vertically oriented and extend outwardly from the well bore in a direction perpendicular to the least principal formation stress in the horizontal plane.

Due to variances and uncertainties related to rock mechanical properties and formation pore pressures in the sandstone reservoir compartments and the shale intervals that encase the sandstone, attempts to propagate fractures through the compartments has yielded unpredictable and often poor results using prior art practices. Furthermore, problems have historically been experienced in propping shale intervals located between more permeable sandstone formations due in part to the lack of fracture fluid leak off adjacent to the shale intervals. Soon after fracturing fluid injection operations are concluded and during fracture closure, the fracturing fluid tends to migrate toward the sandstone formation intervals as the fluid portion of the fracturing fluid leaks off causing relatively low proppant concentration adjacent to the shale intervals. This fracture width pinching phenomena is often compounded by increased proppant embedment adjacent to the shale intervals. The resulting poor conductivity of the propped fracture adjacent to the shale intervals impedes the desired commingling of the separate reservoir compartments into one well.

In crude oil bearing multiple stratified formations, the highly compartmentalized reservoirs are typically solution gas driven whereby the predominant reservoir energy causing the crude oil to move toward production wells completed in the reservoirs is the expansion of the gas in solution with the crude oil under pressure. Typically, after a relatively small percentage of the oil in the reservoir has been produced, the reservoir pressure declines to a level allowing the gas to break out of solution from the crude oil and become free natural gas in the reservoir. Because the viscosity of natural gas is much less than the viscosity of liquid crude oil, the natural gas bypasses the crude oil as it preferentially flows through the reservoir toward the production wells. This is detrimental to the efficient production of the more valuable crude oil because of the loss of the gas drive. Gas breaking out of solution with the crude oil in the reservoir also adversely effects the relative formation permeability to the crude oil as is well known by those skilled in the art of reservoir engineering.

The recovery efficiency of solution gas drive oil reservoirs is relatively low unless secondary or enhanced oil recovery processes are employed, i.e., unless certain gases, steam, chemicals and/or water are injected from specially equipped wells completed at strategic locations in the reservoir to flood, sweep or otherwise drive the crude oil toward the production wells and/or to maintain reservoir pressure at a high enough level whereby the gas remains in solution with the crude oil. Unfortunately, due to the relatively small size of each reservoir compartment and the heterogeneous nature of the hydrocarbon containing formations in most multiple stratified reservoirs, secondary recovery and enhanced oil recovery processes have not been effective using prior art methods.

Thus, there is a need for improved methods of stimulating and producing multiple stratified hydrocarbon reservoirs whereby effective propped fractures are created in the formations which commingle various reservoir compartments and allow the reservoirs to be efficiently produced. Further, in cases where such stratified reservoirs primarily contain crude oil, there is a need for such methods whereby the crude oil is produced by gravity drainage and solution gas expansion drive in combination with enhanced oil recovery processes enabling a larger percentage of the oil originally in place to be recovered at a lower cost per barrel of oil produced.

SUMMARY OF THE INVENTION

The present invention provides improved methods of stimulating and producing wells in a multiple stratified hydrocarbon reservoir having numerous separate reservoir compartments which meet the needs described above and overcome the deficiencies of the prior art. The methods are basically comprised of the steps of drilling a first well bore into a lower part of the stratified reservoir having a horizontal, preferably downwardly sloped portion which intersects a previously drilled second substantially vertical well bore therein. A third well bore is drilled into an upper part of the reservoir having at least one horizontal portion positioned substantially over the horizontal portion of the first well bore. At least one vertically oriented propped fracture is then formed from the horizontal portion of the third well bore which extends through two or more of the reservoir compartments and between the horizontal portions of the third well bore and the first well bore. The fracture causes reservoir compartments to be commingled and hydrocarbons from the compartments to flow into the horizontal portion of the first well bore by way of the fracture and then into the second well bore from where the hydrocarbons are withdrawn.

It is, therefore, a general object of the present invention to provide improved methods of stimulating and producing multiple stratified reservoirs.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 6 is a cross sectional view taken along line 6—6 of FIG. 5.

DESCRIPTION OF PREFERRED EMBODIMENTS

Figure 1:
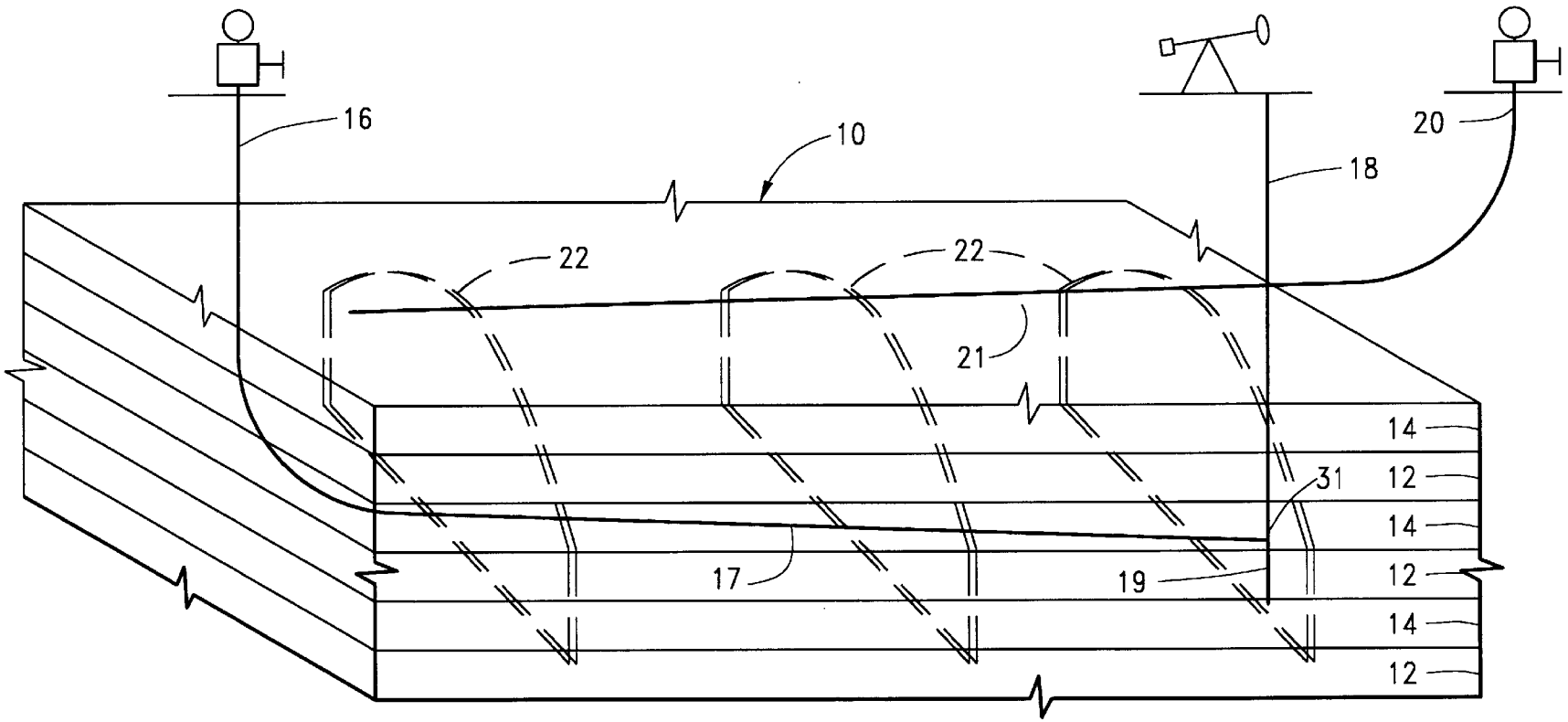
FIG. 1 is a perspective view of a multiple stratified hydrocarbon reservoir which includes a schematic illustration of well bores and fractures formed therein in accordance with the methods of the present invention.

The present invention provides improved methods of stimulating and producing multiple stratified low permeability hydrocarbon reservoirs. As mentioned above, such reservoirs have been fracture stimulated and produced heretofore, but the fracture stimulation treatments have been only marginally successful due to insufficient fracture extension and lack of adequate propping. The improved methods of this invention enable hydrocarbons from the hydrocarbon containing intervals to be co-mingled and produced in a manner whereby gravity drainage of the reservoir is optimized. In addition, the drainage of liquid hydrocarbons from the reservoir can be increased by employing certain enhanced oil recovery processes whereby natural gas, carbon dioxide, steam or other compressible fluid is injected into the reservoir. The injected fluid provides a pressure drive that increases the flow of the liquid hydrocarbons to the bottom of the reservoir from where they are withdrawn. Compressible fluids can also be injected, with or without staged injection of incompressible fluids, into one or more vertical well bores selectively drilled at strategic locations relative to one or more production well bores to provide a flood or sweep or otherwise drive the hydrocarbons laterally to the production well bores as will be further described hereinbelow. In certain cases, the injection of fluids for enhanced oil recovery can also serve to maintain reservoir pressure at a level sufficient to minimize the adverse effects of dissolved natural gas breaking out of solution with the crude oil in the reservoir.

As is customary in developing a technique for producing hydrocarbons from a reservoir, data is acquired and analyzed from new and existing wells in the multiple stratified reservoir to be stimulated and produced to determine the mechanical properties of the multiple permeable and impermeable formations making up the reservoir. In such a reservoir, a hydraulic fracture stimulation treatment performed in a well bore will generally induce a single fracture plane that is vertically oriented and perpendicular to the direction of the least principle horizontal stress in the reservoir. The data and information acquired including the direction of the least principle horizontal stress is utilized in performing the methods of this invention as described hereinbelow.

The term "horizontal" used herein when referring to a well bore or a portion of a well bore means that the well bore or portion thereof is positioned in the range of from about 30° to about 90° from vertical. The term "vertical" used herein when referring to a well bore or portion thereof means that the well bore or portion is positioned in the range of from 0° to about 30° from vertical.

A first embodiment of the methods of this invention is basically comprised of the following steps. A first well bore is drilled into a lower part of the multiple stratified reservoir to be stimulated and produced. The first well bore includes a horizontal portion which is preferably sloped downwardly toward and intersects a previously drilled vertical second well bore in the reservoir. The intersection of the first well bore with the second well bore is preferably above the bottom of the second well bore whereby a sump is formed into which liquid hydrocarbons flow and from which they are pumped to the surface. One or more fractures are then formed in the reservoir extending into two or more separate reservoir compartments whereby hydrocarbons in the reservoir are co-mingled and flow into the horizontal portion of the first well bore by way of the fractures.

An optional third well bore is preferably drilled into an upper part of the reservoir which includes a horizontal portion above the horizontal portion of the first well bore prior to forming the above mentioned fractures. Thereafter, the fractures are formed whereby they extend between the horizontal portions of the first and third well bores. In order to increase the flow of liquid hydrocarbons into the first well bore, fracture clean out chemicals and the like and/or a compressible fluid such as natural gas, carbon dioxide or steam can optionally be injected into the upper portion of the reservoir by way of the horizontal portion of the third well bore.

In an alternate second embodiment, the third well bore, which can be a separate well bore or a lateral well bore of the second well bore, is drilled into an upper part of the reservoir and includes a horizontal portion above the horizontal portion of the first well bore. One or more fractures are then formed from the third well bore which extend vertically above and below the third well bore into two or more reservoir compartments. The lower portions of the fractures extend between the third well bore and the first well bore so that hydrocarbons flow into the first well bore by way of the fractures.

The liquid hydrocarbons and any associated formation water from the commingled reservoir compartments flow by gravity and pressure drive into the first well bore and into the sump of the second well bore from where they flow or are pumped to the surface. Generally, the liquid hydrocarbons and water are pumped to the surface by a downhole mechanical pump positioned in the sump below the intersection with the first well bore. In certain cases, the sump can be configured for subsurface separation of the crude oil and formation water enabling the formation water to be re-injected downhole rather than lifted to surface with the crude oil. As mentioned, the horizontal portion of the first well bore is preferably drilled at an angle from vertical of approximately 80° to produce a downward slope into the sump which promotes gravity flow, minimizes solids buildup, and minimizes well bore friction.

In order to increase the flow of liquid hydrocarbons into the sump, a compressible fluid such as natural gas, carbon dioxide, steam or the like can be injected into the commingled reservoir compartments by way of the third well bore or by way of one or more separate well bores drilled in the reservoir. As the gas fills the uppermost reservoir compartments, it will cause the liquid hydrocarbons to migrate to underlying reservoir compartments and into the first well bore by way of the fractures. Vertical injection well bores can be drilled in strategic locations relative to the multiple fractures in the reservoir for the injection of gases, water and/or alternating stages of gas and water into the various reservoir compartments. The injection wells can also be fractured to produce fractures parallel to the fractures created from the first well bore, but offset some distance to allow hydrocarbon liquids to be flooded, swept or otherwise driven toward the first well bore fractures. Selective flow control devices can be installed in the injection wells to allow injection fluids to target specific reservoir compartments according to injection schedules designed to allow optimized reservoir production.

As is well understood by those skilled in the art, when the horizontal portion of the first well bore or the horizontal portion of the third well bore is oriented in a direction approximately parallel to the direction of the least principle horizontal stress in the reservoir, the vertical fractures formed are oriented in directions approximately perpendicular or transverse to the well bore. So that the transversely oriented fractures formed from the first well bore will intersect the third well bore or so that fractures formed from the third well bore will intersect the first well bore, the horizontal portions of the first and third well bores are drilled in substantially parallel directions. One or more secondary laterals may be drilled from the horizontal portion of the well bore to be intersected by the fractures in a configuration to maximize the probability that the fractures formed will intersect that well bore. The horizontal portion or portions of the well bore to be intersected can be completed open hole with a slotted liner disposed therein or in other suitable ways known to those skilled in the art. A pressure/temperature sensor can be installed in the well bore to be intersected so that when the well bore is intersected by a fracture being formed, the fracturing fluid entering the well bore will be sensed by the pressure/temperature sensor and the fluid will flow out of the reservoir by way of the well bore.

In some applications of the present invention, it is preferable to form a single vertical fracture extending from the horizontal portion of the first or third well bore along its length rather than forming a plurality of vertical fractures oriented transversely to the horizontal portion. In such an application, the horizontal portion of the well bore from which the fracture is to be formed is drilled in a direction substantially perpendicular to the direction of least principle horizontal stress in the reservoir, and the horizontal portion or portions of the well bore to be intersected by the fracture are formed in directions transverse to the direction of the horizontal portion of the well bore from which the fracture is to be formed. The resulting single fracture extends vertically from the horizontal portion of the well bore from which it is formed along the length of the well bore and intersects the horizontal portion or portions of the other well bore extending transversely to the direction of the fracture.

When a plurality of spaced fractures oriented transversely to the horizontal portion of the first or third well bore are required, they can be formed utilizing techniques known to those skilled in the art. A presently preferred such technique is to complete the well bore from which fractures are to be formed with cemented casing in the non-horizontal portion thereof and a cemented liner in the horizontal portion thereof. A first opening or set of openings are cut in the liner for forming a first vertical fracture. The opening or set of openings can be cut in the liner utilizing various techniques, e.g., an abrasive liquid slurry jetting technique. After the first opening or set of openings has been formed, a hydraulic fracturing fluid is pumped into the liner and through the first opening or set of openings at a rate and pressure sufficient to create a fracture and extend it until it intersects the horizontal portion of the other well bore above or below it.

The fracturing fluid utilized can be any of the viscous fracturing fluids known to those skilled in the art which include suspended proppant material so that when completed the fracture will be propped open. Preferably, the fracturing fluid includes a high concentration of curable resin coated proppant and the fracturing fluid is designed to produce a tip screen-out after the fracture has intersected the horizontal portion or portions of the third well bore. In a tip screen-out, the proppant is caused to pack-off against the tip of the fracture causing further fracture extension to stop. After initiating the tip screen-out, the fracture pressure increases as the fracture width increases. The fracture is packed with a relatively high concentration of proppant as continuous leak-off occurs through the walls of the induced fracture. Upon the curing of the resin coated proppant, a highly permeable fracture is formed that effectively co-mingles the compartments of the reservoir through or into which the fracture extends.

After the first fracture has been completed, a retrievable bridge plug is set in the liner so that the liner is isolated from the first fracture. A second opening or set of openings is cut into the liner spaced a distance from the first opening or openings and additional hydraulic fracturing fluid is pumped into the liner by way of the well bore. The fracturing fluid flows through the second opening or set of openings at a rate and pressure sufficient to create a second fracture and extend it to a horizontal portion of the other well bore. The process of isolating the liner, cutting an opening or set of openings therein and pumping fracturing fluid is repeated to produce additional spaced fractures between the horizontal portions of the first and third well bores along the length of the horizontal portion of the first well bore.

When the horizontal portion of the first or third well bore extends in a direction substantially perpendicular to the direction of least principle horizontal stress in the reservoir and a single fracture extending therefrom is to be formed, a plurality of upwardly facing openings are formed in spaced relationship along the length of the liner in the well bore from which the fracture is to extend. A hydraulic fracturing fluid containing proppant material is then pumped into the liner and through the spaced openings at a rate and pressure sufficient to create a fracture and extend it to the horizontal portion or portions of the third well bore. The fracture is packed with proppant as described above to thereby provide a permeable conduit through which hydrocarbons in the reservoir can flow into the horizontal portion of the first well bore.

As will now be understood, the fracture or fractures formed with at least portions thereof extending between the horizontal portions of the first and third well bores provide one or more flow passages through at least two and preferably more of the separate compartments of the reservoir whereby hydrocarbons co-mingle and flow to the horizontal portion of the first well bore. The hydrocarbons flow through the horizontal portion of the first well bore to the second well bore from which the hydrocarbons are withdrawn. As will also be understood, additional sets of interconnected first, second and third well bores and injection wells can be drilled throughout the multiple stratified reservoir field area to thereby simultaneously produce hydrocarbons from the entire reservoir.

Figure 2:
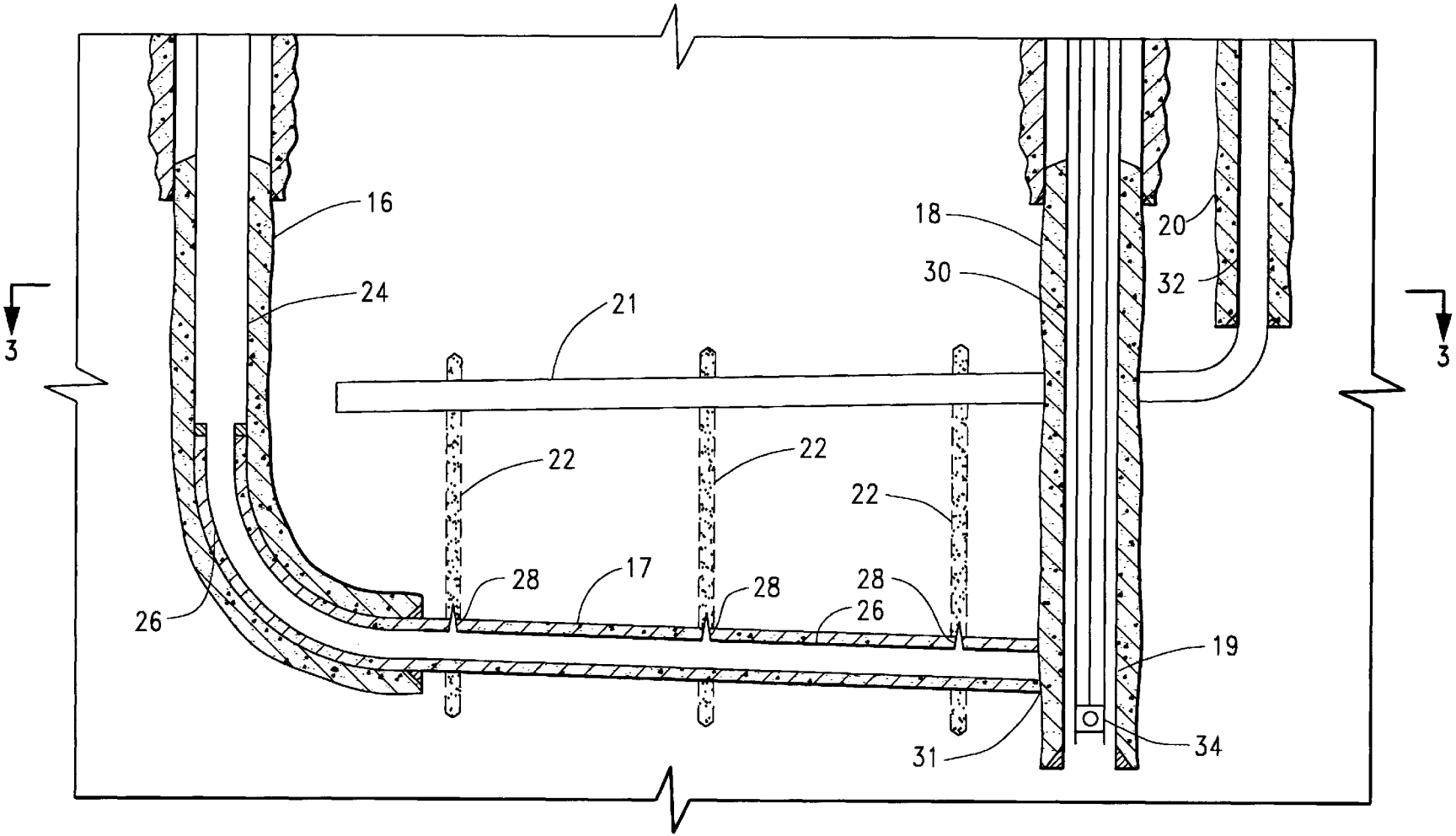
FIG. 2 is a side cross sectional more detailed view of the well bores and fractures of FIG. 1.
Figure 3:
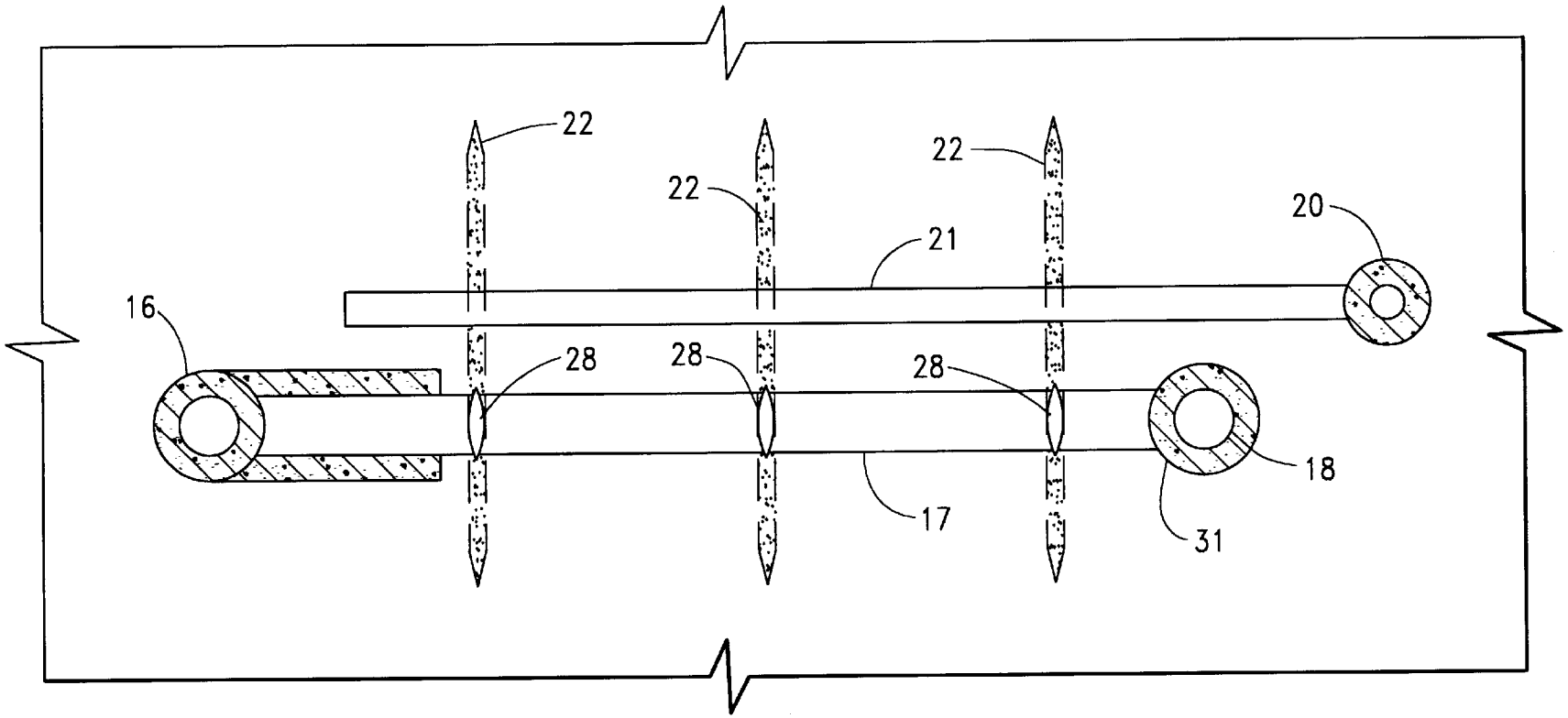
FIG. 3 is a cross sectional view taken along line 3—3 of FIG. 2.

In order to further illustrate the methods of this invention, drawings showing a multiple stratified reservoir with well bores and fractures formed therein in accordance with the methods of this invention are provided. Referring to FIGS. 1 through 3 of the drawings, and particularly to FIG. 1, a multiple stratified reservoir is illustrated and generally designated by the numeral 10. As described above, the reservoir 10 is comprised of hydrocarbon containing sandstone layers 12 having layers of shale or other rock 14 therebetween.

In accordance with the first embodiment of the methods of this invention, a first well bore 16 is drilled into a sandstone layer 14 in a lower part of the reservoir 10 and extended horizontally whereby the horizontal portion 17 intersects a previously drilled second well bore 18 at a point 31 whereby a sump portion 19 of the second well bore extends below the intersection. As mentioned above, the horizontal portion 17 of the first well bore 16 is sloped downwardly toward the second well bore 18. As described above, an optional third well bore 20 is preferably drilled into an upper part of the reservoir 10 which also includes a horizontal portion 21. The horizontal portion 17 of the first well bore 16 is drilled in a direction substantially parallel to the direction of least principle horizontal stress in the reservoir whereby when spaced fractures 22 (shown in dashed lines) are formed, they are substantially perpendicular to the horizontal portion of the first well bore 16.

Referring now to FIGS. 2 and 3, the well bores 16, 18, and 20 and the fractures 22 are shown in greater detail. The first well bore 16 includes casing 24 cemented in the non-horizontal portion thereof and a liner 26 cemented in the horizontal portion thereof. The liner 26 includes a plurality of spaced openings 28 cut therein with the spaced fractures 22 extending between the openings 28 in the liner 26 and the horizontal portion 21 of the third well bore 20. The second and third well bores 18 and 20 are shown having casing 30 and 32, respectively, cemented in the non-horizontal portions thereof. The horizontal portion of the third well bore 20 is completed open-hole. A liquid hydrocarbon pump 34 is disposed in the sump portion 19 of the second well bore 18.

Figure 4:
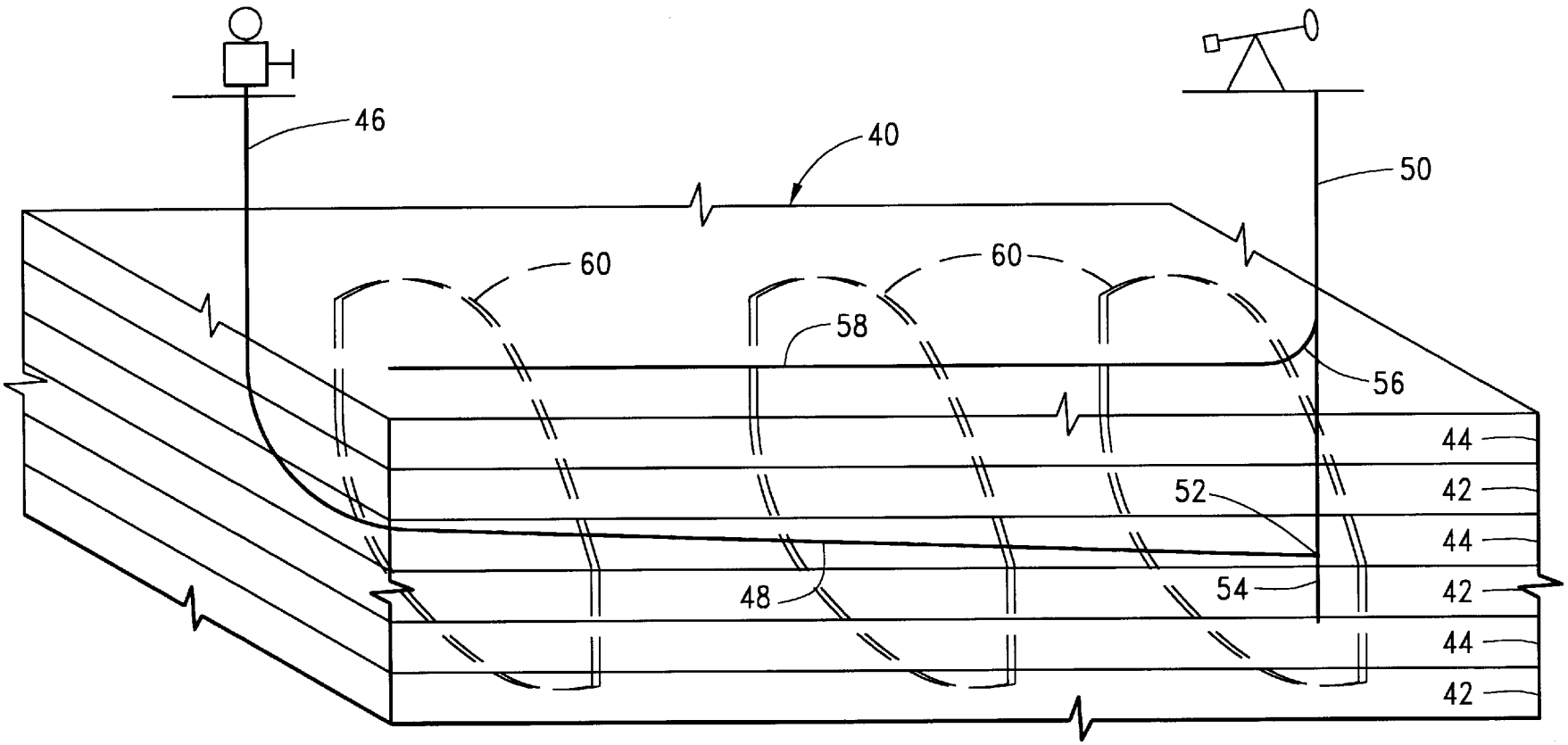
FIG. 4 is a perspective view similar to FIG. 1, but illustrating an alternate arrangement of well bores and fractures formed in accordance with the methods of this invention.
Figure 5:
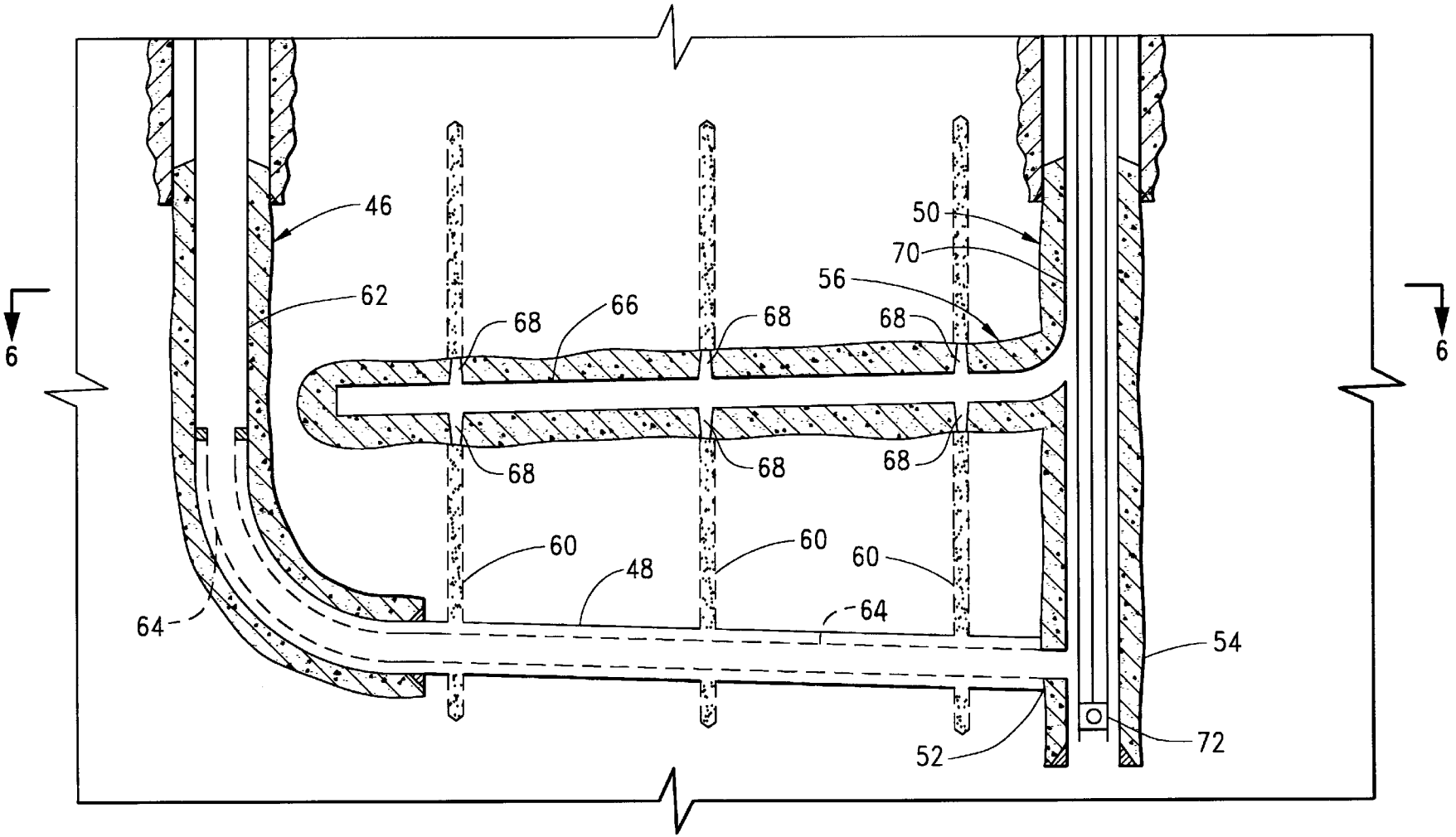
FIG. 5 is a side cross sectional more detailed view of the well bore and fractures of FIG. 4.
Figure 5:
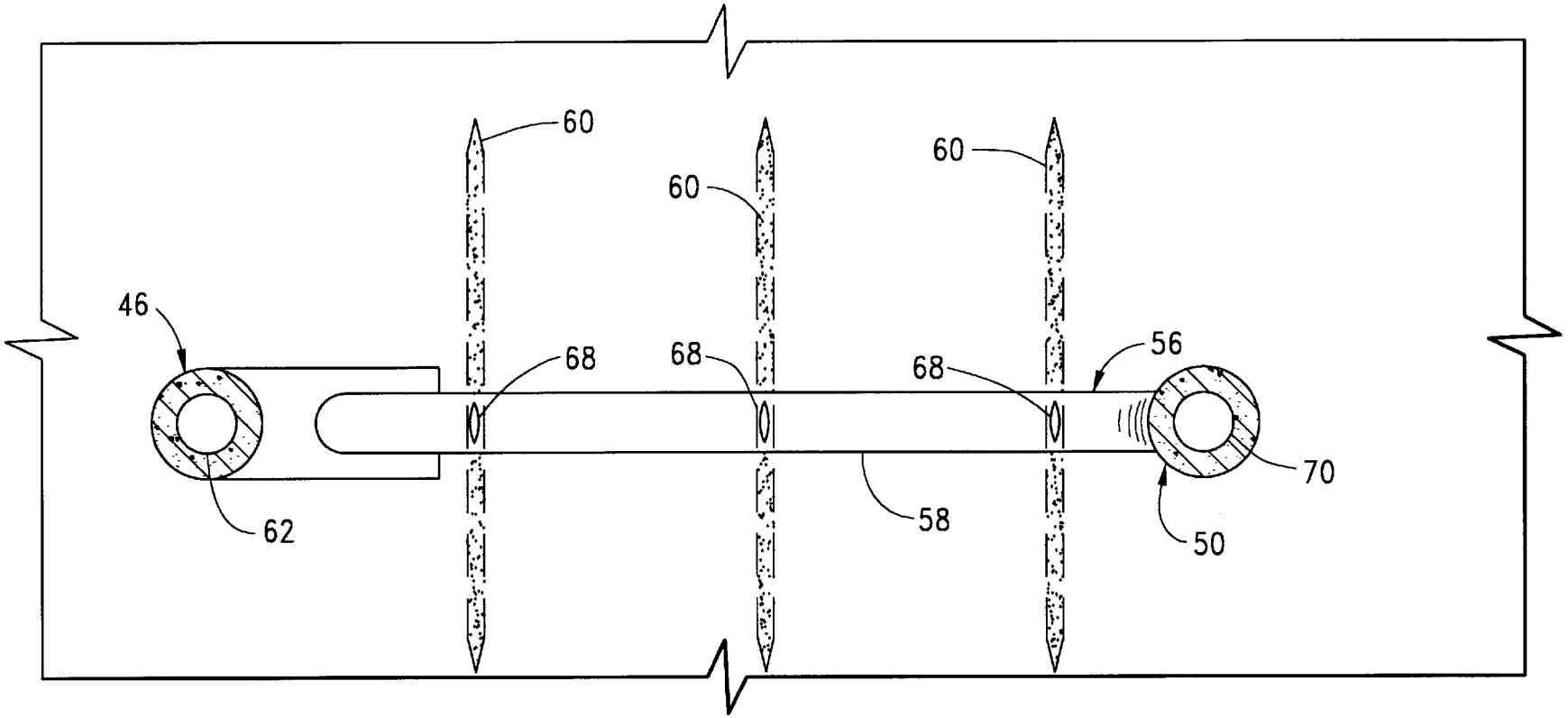

Referring now to FIGS. 4 through 6 of the drawings, and particularly to FIG. 4, a multiple stratified reservoir is illustrated and generally designated by the numeral 40. The reservoir 40 is comprised of hydrocarbon containing sandstone layers 42 having layers of shale or other rock 44 therebetween.

In accordance with the second embodiment of the methods of this invention, a first well bore 46 is drilled into a sandstone layer 44 in a lower part of the reservoir 40 and extended horizontally whereby the horizontal portion 48 intersects a previously drilled second well bore 50 at a point 52 whereby a sump portion 54 of the second well bore extends below the intersection. As mentioned above, the horizontal portion 48 of the first well bore 46 is sloped downwardly toward the second well bore 50. A third well bore 56 which is preferably a lateral well bore from the second well bore 50, but which can also be a separate well bore like the well bore 20 described above is drilled into an upper part of the reservoir 40. The third well bore 56 includes a horizontal portion 58.

The horizontal portion 58 of the third well bore 56 is drilled in a direction substantially parallel to the direction of least principle horizontal stress in the reservoir whereby when spaced fractures 60 (shown in dashed lines) are formed from the well bore 56, they are substantially perpendicular to the horizontal portion 58 of the third well bore 56. The fractures 60 extend above and below the third well bore 56 and the lower portions of the fractures 60 intersect with the horizontal portion 48 of the first well bore 46.

Referring now to FIGS. 5 and 6, the well bores 46, 50 and 56 and the fractures 60 are shown in greater detail. The first well bore 46 includes casing 62 cemented in the vertical portion thereof and a slotted liner 64 disposed in the open-hole horizontal portion 48 thereof. The third well bore 56 includes a liner 66 cemented in the horizontal portion 58 thereof. The liner 66 includes a plurality of spaced openings 68 cut therein with the spaced fractures 60 extending upwardly and downwardly from the openings 68. The lower portions of the fractures 60 extend between the openings 68 in the liner 66 and the horizontal portion 48 of the first well bore 46. The second well bore 50 is shown having casing 70 cemented in the vertical portion thereof. A liquid hydrocarbon pump 72 is disposed in the sump portion 54 of the second well bore 50.

In order to illustrate the methods of the invention still further, the following example is given.

EXAMPLE

Referring again to FIGS. 1 through 3 of the drawings, a multiple stratified reservoir 10 comprised of low permeability heterogenous sandstone layers 12 separated by shale layers 14 exists in an interval of about 1000 feet. The permeabilities of the sandstone layers 12 to air range from less than 1 md to approximately 50 md with an average of about 8 md. The porosities of the sandstone layers 12 range from about 12% to about 16%. All of the sandstone layers 12 contain oil with connate water saturations of approximately 30% and solution gas drives. The gas to oil ratios of the hydro-carbons produced from the layers range from about 500 to about 1000 standard cubic feet per barrel. The gravity of the crude oil is between about 22° and 24° API.

A first well bore 16 is drilled having a horizontal portion near the bottom of the reservoir 10 which is about 3500 feet long. The horizontal portion of the first well bore 16 extends in a direction substantially parallel to the direction of least principle horizontal stress in the reservoir 10 and intersects a previously drilled vertical second well bore 18. A third well bore 20 is drilled into an upper part of the reservoir 10 having a horizontal portion above and substantially parallel to the horizontal portion of the first well bore 16. Three transverse vertical fractures 22 spaced about 500 feet from each other are formed between the horizontal portions of the first and third well bores 16 and 20. The three fractures are propped and have radiuses from the horizontal portion of the first well bore of about 400 feet. The drainage area of the well bore and fracture system is about 155 acres and the average net effective pay depth is about 235 feet. The oil initially in place is about 20,640,000 barrels, 25% or more of which will be recovered by the methods of the present invention.

Thus, the present invention is well adapted to carry-out the objects and attain the ends and advantages mentioned as well as those which are inherent therein. While numerous changes may be made by those skilled in the art, such changes are encompassed within the spirit of this invention as defined by the appended claims.

What is claimed is:

1. A method of stimulating and producing a multiple stratified hydrocarbon reservoir having numerous separate reservoir compartments comprising the steps of:

(a) drilling a first well bore into a lower part of said stratified reservoir having a horizontal portion which intersects a previously drilled second well bore therein;

(b) drilling a third well bore into an upper part of said reservoir having at least one horizontal portion positioned above said horizontal portion of said first well bore;

(c) forming at least one fracture from said horizontal portion of said third well bore extending into two or more of said separate reservoir compartments and extending between said horizontal portions of said third well bore and said first well bore whereby hydrocarbons in said reservoir flow into said horizontal portion of said first well bore by way of said fracture and then into said second well bore; and (d) withdrawing said hydrocarbons from said reservoir by way of said second well bore.

2. The method of claim 1 wherein said horizontal portions of said first and third well bores extend in directions substantially parallel to the direction of least principal horizontal stress in said reservoir.

3. The method of claim 1 wherein said horizontal portion of said first well bore includes a slotted liner disposed therein.

4. The method of claim 1 wherein said horizontal portion of said third well bore includes a liner cemented therein.

5. The method of claim 4 wherein said fracture extending from said horizontal portion of said third well bore is formed in accordance with step (c) by cutting at least one opening in said liner and pumping a hydraulic fracturing fluid into said liner and through said opening at a rate and pressure sufficient to create said fracture and extend it through said reservoir compartments.

6. The method of claim 1 herein said second well bore includes a liquid hydrocarbon pump disposed therein for withdrawing liquid hydrocarbons therefrom in accordance with step (d).

7. The method of claim 1 wherein said fracture formed in accordance with step (c) is packed with proppant.

8. The method of claim 2 wherein a plurality of fractures are formed in said reservoir in accordance with step (c).

9. A method of stimulating and producing a multiple stratified hydrocarbon reservoir comprising the steps of:

(a) drilling a first well bore into a lower part of said stratified reservoir having a horizontal portion which extends in a direction substantially parallel to the direction of least principal horizontal stress in said reservoir and intersects a previously drilled second well bore therein;

(b) drilling a third well bore into an upper part of said reservoir having a horizontal portion which extends in a direction substantially parallel with said horizontal portion of said first well bore;

(c) forming a plurality of spaced fractures from said third well bore extending between said horizontal portions of said third well bore and said first well bore whereby hydrocarbons in said reservoir flow into said horizontal portion of said first well bore by way of said fractures and then into said second well bore; and (d) withdrawing said hydrocarbons from said reservoir by way of said second well bore.

10. The method of claim 9 wherein said horizontal portion of said first well bore includes a slotted liner disposed therein.

11. The method of claim 9 wherein said horizontal portion of said third well bore includes a liner cemented therein.

12. The method of claim 9 wherein said horizontal portion of said first well bore is sloped downwardly toward said second well bore.

13. The method of claim 12 wherein said first well bore intersects said second well bore at a point above the bottom of said second well bore whereby a sump is formed in said second well bore.

14. The method of claim 9 wherein said second well bore includes a liquid hydrocarbon pump disposed therein for withdrawing liquid hydrocarbons therefrom in accordance with step (d).

15. The method of claim 13 wherein a liquid hydrocarbon pump is disposed in said sump formed in said second well bore for withdrawing liquid hydrocarbons therefrom in accordance with step (d).

16. The method of claim 11 wherein said spaced fractures extending from said horizontal portion of said third well bore are formed in accordance with step (c) by cutting a first opening in said liner facing said horizontal portion of said first well bore, pumping a hydraulic fracturing fluid into said liner and through said first opening at a rate and pressure sufficient to create a first fracture and extend it to said horizontal portion of said first well bore, isolating said liner from first opening therein, cutting a second opening in said liner spaced a distance from said first opening, pumping a hydraulic fracturing fluid into said liner and through said second opening at a rate and pressure sufficient to create a second fracture and extend it to said horizontal portion of said first well bore, and repeating said isolating, cutting and pumping steps to produce additional spaced fractures between said horizontal portion of said third well bore and said horizontal portion of said first well bore.

17. A method of stimulating and producing a multiple stratified hydrocarbon reservoir comprising the steps of:

(a) drilling a first well bore into a lower part of said stratified reservoir having a horizontal portion which extends in a direction substantially perpendicular to the direction of least principal horizontal stress in said reservoir and intersects a previously drilled second well bore therein;

(b) drilling a third well bore into an upper part of said reservoir having a horizontal portion which extends in a direction transverse to said horizontal portion of said first well bore;

(c) forming at least one fracture from said third well bore extending between said horizontal portions of said third well bore and said first well bore whereby hydrocarbons in said reservoir flow into said horizontal portion of said first well bore by way of said fracture and then into said second well bore; and (d) withdrawing said hydrocarbons from said reservoir by way of said second well bore.

18. The method of claim 17 wherein said horizontal portion of said first well bore is sloped downwardly toward said second well bore.

19. The method of claim 17 wherein said first well bore intersects said second well bore at a point above the bottom of said second well bore whereby a sump is formed in said second well bore.

20. The method of claim 17 wherein said second well bore includes a liquid hydrocarbon pump disposed therein for withdrawing liquid hydrocarbons therefrom in accordance with step (d).

* * * * *